United States Patent [19]

Renk et al.

[11] 4,244,449

[45] Jan. 13, 1981

[54] TENSIONING DEVICE FOR TENSIONING OF HYDRAULIC HOSES ON TELESCOPIC LIFT MAST ASSEMBLIES

[75] Inventors: Friedrich Renk; Jürgen Händel, both of Dortmund, Fed. Rep. of Germany

[73] Assignee: O & K Orenstein & Koppel Aktiengesellschaft, Berlin, Fed. Rep. of Germany

[21] Appl. No.: 22,546

[22] Filed: Mar. 21, 1979

[30] Foreign Application Priority Data

Apr. 7, 1978 [DE] Fed. Rep. of Germany ..... 2815024

[51] Int. Cl.[3] ..... B66B 9/20

[52] U.S. Cl. ..... 187/9 E; 254/414; 414/592

[58] Field of Search ..... 187/9 R, 9 E; 254/172, 254/198, 190 R; 242/75.3, 155 R; 267/124; 226/195; 92/132

[56] References Cited

U.S. PATENT DOCUMENTS

| | | | |
|---|---|---|---|
| 1,158,432 | 11/1915 | Benoit | 242/155 R |
| 2,249,947 | 7/1941 | Doe | 254/172 |
| 2,932,419 | 4/1960 | Harris | 187/9 E |
| 3,023,979 | 3/1962 | Megens et al. | 242/155 R |
| 3,785,511 | 1/1974 | Bonnamy et al. | 254/172 |

*Primary Examiner*—Stanley H. Tollberg
*Assistant Examiner*—Kenneth Noland
*Attorney, Agent, or Firm*—Martin A. Farber

[57] ABSTRACT

Tensioning device for tensioning of hydraulic flexible tubes on telescopic lift mast assemblies of fork lift trucks with the flexible tubes being turned-around over a pulley which is rotatably mounted on the stationary outer upright and an additional pulley which is rotatably mounted on the sliding inner upright. A holder is engaged by a spring, the holder being guided on the stationary outer upright in a guide, the holder carrying a rotatable pulley.

2 Claims, 3 Drawing Figures

30
30
31
32
17
20
22
25
24
19a
19
23
18
21

TENSIONING DEVICE FOR TENSIONING OF HYDRAULIC HOSES ON TELESCOPIC LIFT MAST ASSEMBLIES

The invention relates to a tensioning or tightening device for tensioning of flexible hydraulic tubes on telescopic lift mast assemblies of fork lift trucks with the flexible tubes being turned-around over a pulley which is rotatably mounted on the stationary outer upright and with an additional pulley which is rotatably mounted on the sliding inner upright.

With a known tensioning device, which was named by the producer as a "Spannrolle" (tensioning pulley), the flexible hose is clamped between two kidney shaped clamping or gripping jaws. A lever which is articulated rotatably on the center point of the jaw pair carries a pully on its other end, which pulley is supported on the flexible hoses. A helical spring, which acts between the pair of jaws and the lever, rotates the jaw pair and winds up the flexible hoses over the outer contour thereof. Since this tensioning device hangs free in the flexible tubes, uncontrolled mechanical oscillations occur with traveling or movement, which with narrow or cramped assembly or installation conditions can lead to damage of the structural members which lie in the vicinity of the tensioning device or of the "Spannroller" (the tensioning pulley).

With another tensioning device the tension force of a "Spannroller" (tensioning pulley), which is guided on longitudinal guides, is brought about by a weight. This system unneccessarily loads the holder or support of the turn-around pulley and the longitudinal guide by large forces of mass and increases the weight of the vehicle at an undesired place.

Accordingly it is an object of the present invention to guide the flexible tubes and to tension or tighten them in such a manner as to avoid undesired oscillations of the tensioning element which are caused by moving and traveling jolts by a defective supporting and/or by too large masses.

It is another object of the present invention to aid the solution of the above object in the manner that a holder (e.g., 16, 40) is loadably engaged by a spring (20, 43), the holder being guided on the stationary outer upright (11) in a guide, with the holder carrying a rotatable pulley (e.g. 25, 46).

An advantage of the arrangement in accordance with the present invention is that only a small assembly or installation space is required, and that the weight is low and consequently even the loadings which are brought about by the forces of mass. The forces which occur now are defined by the pretension of the spring, and the tension forces can be easily adjusted to the type of tube or hose which is being used by varying the pretensioning of the spring.

In accordance with another object of the invention a tube (17) is fastened onto the stationary outer upright (11), the tube being formed with a slot (22), a guide rod (18) being arranged in the central axis of the tube, and a slide (19) slides on the guide rod, the slide being guided in the slot (22) and being connected with a holder (19, 21, 23) for a pulley (25), and the slide is engaged by means of a spring (20).

Still further in accordance with another object of the invention a rotatably mounted lever (40) is pivotally fastened on the stationary outer upright (11), the lever being engaged by a tension spring (43), the lever carrying a rotatable pulley (46) on its free end.

With the above and other objects in view the invention will be more clearly understood from the following description of two preferred embodiments when considered in connection with the accompanying drawings of which:

Figure 1:
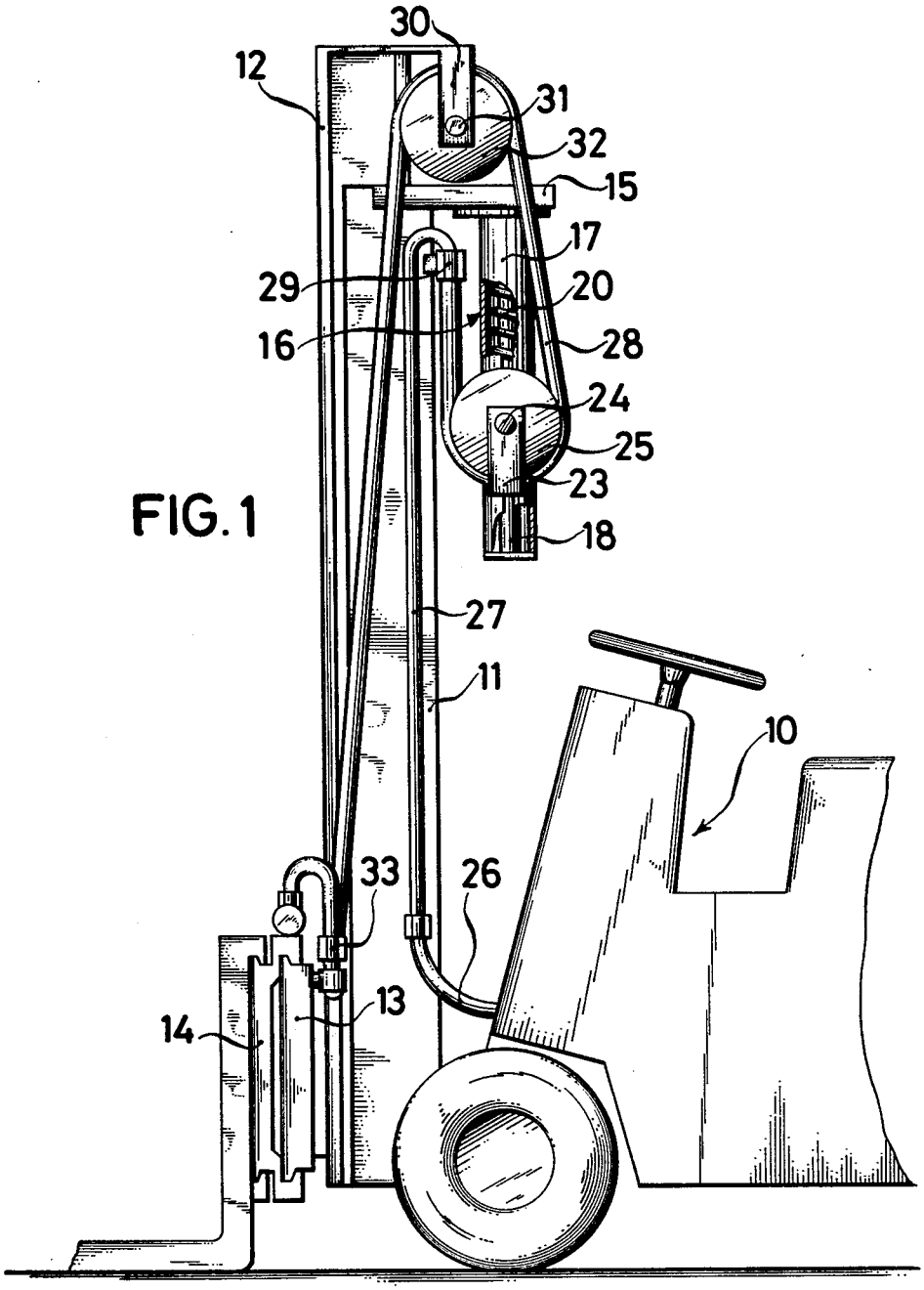
FIG. 1 is a side view of the front part of a fork lift truck with a telescopic lift mast assembly and the tensioning device in accordance with the present invention broken away in parts.
Figure 2:
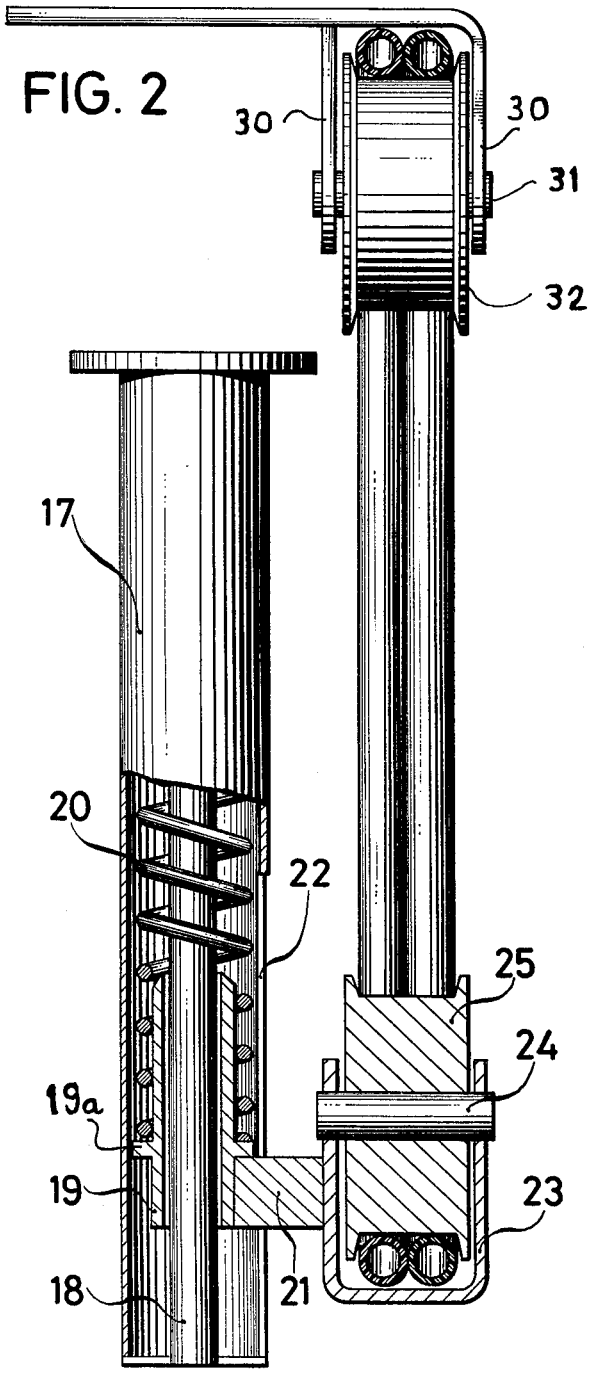
FIG. 2 is a partial sectional view of the tensioning device of FIG. 1 in side view and in enlarged scale compared to FIG. 1.

Referring now to the drawings and more particularly to FIGS. 1 and 2, on a fork lift truck 10 there is mounted a telescopic lift mast assembly comprising a stationary outer upright 11, a sliding inner upright 12 and an attachment device 14, the latter being fastened on a carrier plate 13. A cross piece or arm 15 is arranged on the upper end of the stationary outer upright 11.

The loading or tensioning device 16 is secured to the arm 15. The tensioning device 16 comprises a tube 17 which serves as a housing (the guide rod 18 of which is secured in the central axis of the tube 17 to the ends thereof), a tubular slide 19 (which is slidably disposed on the rod 18) and a spring 20. By means of the spring the slide 19 is engaged. In this respect the spring 20 is a tension spring which abuts the upper end or cover of the tube 17 and a radial flange **19*a* on the slide 19**.

A joint connection bar 21 is connected with the slide 19. The joint bar 21 extends through a slot 22 which is longitudinally formed in the tube 17. A holder or support 23 for a pulley 25 is welded on the outer or free end of the joint bar 21, the pulley 25 being rotatably mounted in the holder 23 on an axle 24 which extends into opposite sides of the holder 23.

By means of a hose 26 for actuation of the attachment device 14, the pressurized hydraulic oil, which is fed by a pump (not shown, which pump is arranged in the fork lift truck), is led via the tube 27 connected to the hose 26 (which tube 27 is secured by the stationary outer upright 11) up to the upper end of the stationary outer upright 11 and from there it is fed to a hose 28. The hose 28 is connected to the tube 27 by means of the screwing connection, coupling or union piece 29. The hose 28 is guided around the pulley 25 (which pulley 25 is applied and operatively engaged and loaded by the spring 20) and from there, the hose 28 is guided around the pulley 32 to a screw joint connection 33. The pulley 32 is mounted at a pivot point (axle) 31 by means of a holder 30, the latter being connected to the uprights 11 and 12. A consumer, for example, the attachment device 14, is operatively connected to the connection 33.

Figure 3:
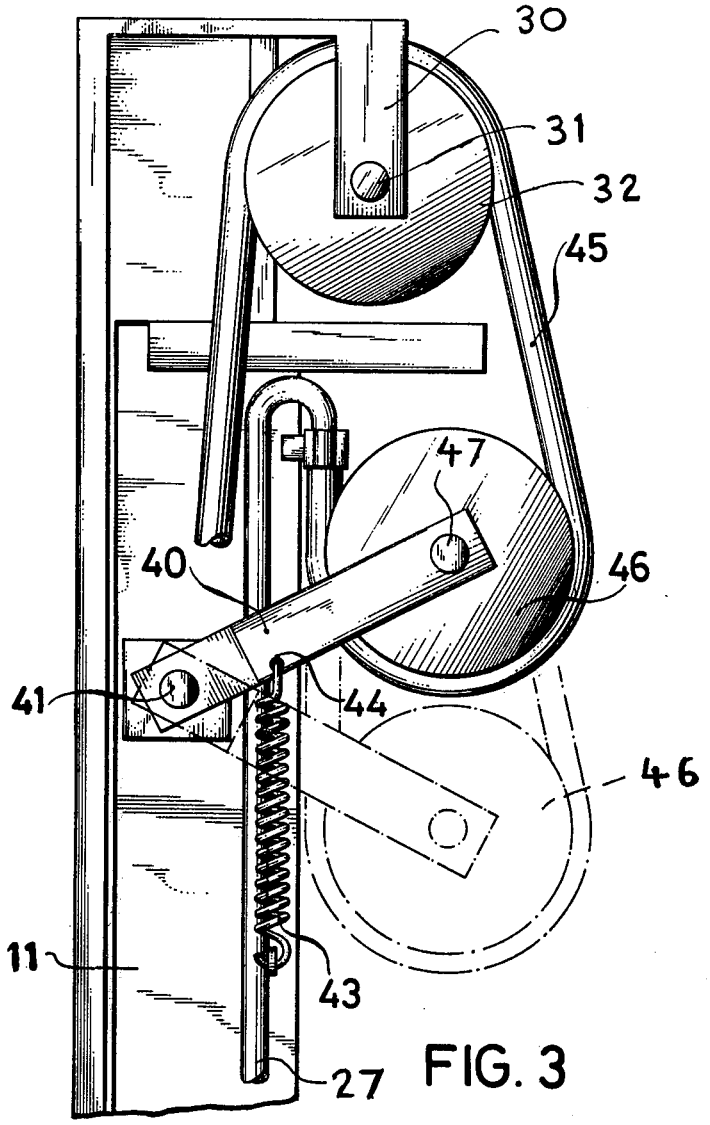
FIG. 3 is a further embodiment of the tensioning or tightening device in side view.

In FIG. 3 another embodiment of the tensioning device is illustrated. In this manner the hose 45 is tensioned and tightened by means of a lever 40 (which lever is pivotally mounted to the stationary outer upright 11 at the pivot point 41), a tension spring 43 (the latter acting on the stationary outer upright 11 at the connection point 42) and a moveable pulley 46, whereby the tension spring 43 acts on the lever 43 between its ends in a bore 44 formed in the lever 40. The free end of the lever mounts an axle 47 of the pulley 46, the pulley 46 being rotatable mounted thereon, preferably with another identical lever (not shown) being mounted on the other side through which the axle 47 likewise extends. This device now operates similar to the first embodiment. The remaining parts are the same as those of the first embodiment and are not again described.

While there have been described two embodiments of the invention, it is to be understood that these embodiments are given by example only and not in a limiting sense.

We claim:

1. In a tensioning device for tensioning of hydraulic flexible tubes on telescopic lift mast assemblies of fork lift trucks with the flexible tubes being turned-around over a pulley which is rotatably mounted on the stationary outer upright and an additional pulley which is rotatably mounted on the sliding inner upright, the improvement comprising a holder, means for guiding said holder on the stationary outer upright, a spring operatively engaging said holder, a rotatable pulley being rotatably mounted on said holder, said guiding means comprises, a tube fastened on the upright column, said tube being formed with a slot, a guide rod is arranged in the central axis of said tube, a slide is slidably mounted on said guide rod, said slide is guided in said slot and is connected with said holder for said rotatable pulley, said spring engages said slide.

2. The device as set forth in claim 1, further comprising a joint bar is connected to said slide and to said holder, said joint bar extends through said slot in said tube, the latter constituting a longitudinal slot, said slide is tubular shaped and said guide rod extends through said slide, said slide is formed with a radially outwardly extending flange, said spring constitutes a helical compression spring engaging said flange and an upper portion of said tube, said holder is U-shaped in cross-section extending around said rotatable pulley rotatably mounted in said holder, the additional pulley is rotatably, but fixedly mounted to the sliding inner upright above said rotatable pulley, the flexible tubes being adapted to turn around said rotatable pulley and said additional pulley on remote facing semicircular portions of their peripheries respectively.

* * * * *